United States Patent [19]

Pansini

[11] 3,932,281

[45] Jan. 13, 1976

[54] LEAF TRAP KIT FOR SWIMMING POOLS

[76] Inventor: Andrew L. Pansini, 180 Los Cerros Drive, Greenbrae, Calif. 94904

[22] Filed: Dec. 12, 1974

[21] Appl. No.: 531,897

[52] U.S. Cl. ..... 210/163; 15/1.7; 210/169

[51] Int. Cl.[2] ..... E03F 5/06

[58] Field of Search ..... 15/1.7; 210/169, 166, 163

[56] References Cited

UNITED STATES PATENTS

| | | | |
|---|---|---|---|
| 759,141 | 5/1904 | Thurman | 15/1.7 UX |
| 2,786,026 | 3/1957 | Stark | 210/169 |
| 2,902,705 | 9/1959 | Eistrup | 15/1.7 |
| 3,063,077 | 11/1962 | Pansini | 210/169 X |
| 3,091,340 | 5/1963 | Pansini | 210/169 UX |
| 3,132,364 | 5/1964 | Oxley | 15/1.7 |
| 3,172,415 | 3/1965 | Maushund | 15/1.7 X |
| 3,321,080 | 5/1967 | Pansini et al. | 210/169 X |
| 3,378,858 | 4/1968 | Jacuzzi | 210/166 X |
| 3,444,575 | 5/1969 | Martin | 15/1.7 |
| 3,517,813 | 6/1970 | Thaler | 210/166 |

*Primary Examiner*—Theodore A. Granger
*Attorney, Agent, or Firm*—Naylor, Neal & Uilkema

[57] ABSTRACT

This leaf trap kit for swimming pools includes an inverted, perforate basket which is fitted over the main drain outlet of the pool, a dome-like housing open at its underside and having lateral openings to admit leaves into the space between the housing and the inverted basket and having a top opening through which such leaves may be removed, and a vacuum cleaner head fittable over the housing to remove the leaves from the top opening of the housing.

4 Claims, 2 Drawing Figures

LEAF TRAP KIT FOR SWIMMING POOLS

Figure 1:
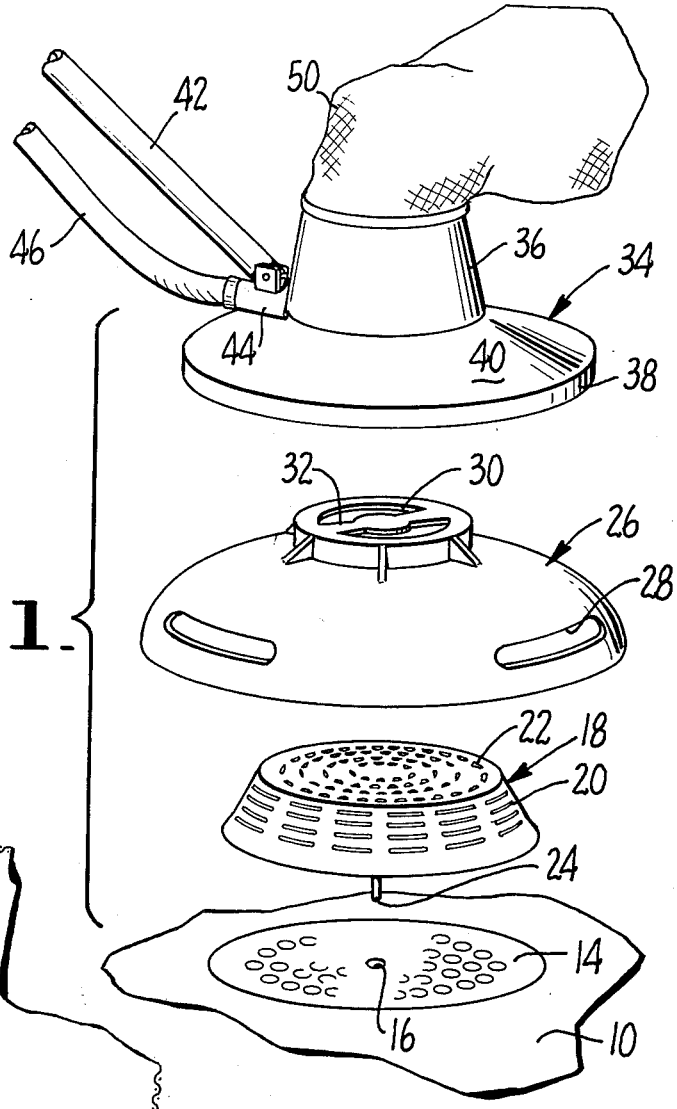

This leaf trap invention is an improvement over prior swimming pool leaf traps, with particular reference to the type shown in my prior U.S. Pat. No. 3,667,611. This prior leaf trap of mine had a dome-like housing provided with a lateral opening for the reception of leaves, and a perforate bottom wall to trap the leaves within the housing. To remove the leaves, it was necessary to remove the entire trap from the pool and this would usually result at least to some degree to redistributing dirt in the pool which may have been sparkling clean before removal of the trap. Also, this prior trap of mine was dependent for efficient working upon the establishment of a peripheral seal between the housing and the pool floor to prevent leaves from getting in beneath the lower edge of the housing and beneath the lower perforate wall of the housing. Due to irregularities in the pool floor it was frequently impossible to obtain such an edge seal particularly at the distance of the location of the housing edge away from the main drain. In the leaf trap of the present invention, it is immaterial that leaves get into the housing below the bottom edge of the housing, and the trap to floor seal is more efficiently obtained by the smaller, separate inverted basket which forms an edge seal with the main drain inlet plate itself rather than with the pool floor outside of the periphery of the main drain.

An object of the invention is to provide a leaf trap enabling the removal therefrom of collected leaves without requiring the removal of the leaf trap from the pool.

Another object of the invention is the provision of a leaf trap which includes a sieve part and a separate housing part, the latter being in sealing relation directly with the inlet plate of the main drain opening.

Figure 2:
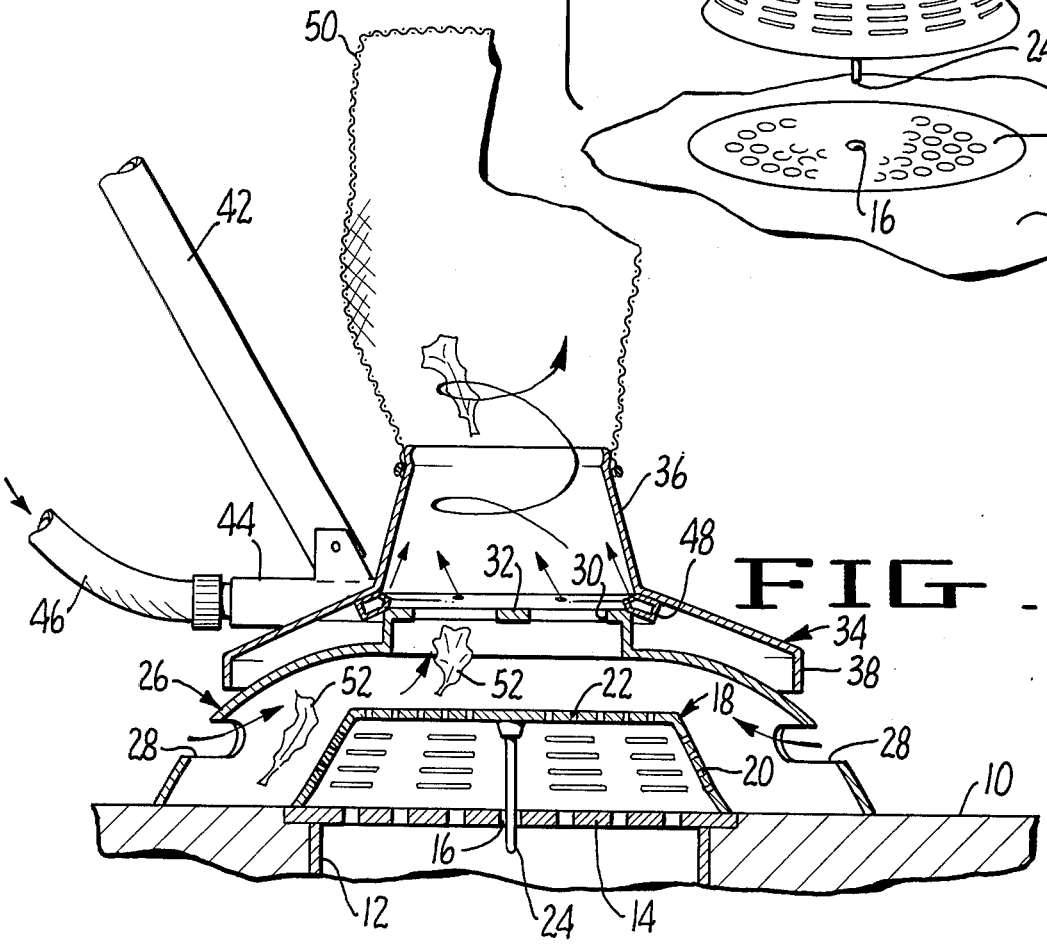

Other objects and advantages of the invention will be apparent from the following description taken in conjunction with the drawing forming part of this specification, and in which:

FIG. 1 is an exploded view in perspective of the leaf trap and leaf removal system of the invention; and FIG. 2 is an enlarged view in vertical diametral section through all of the components of FIG. 1, showing them in working relation to each other.

With reference to the drawing, the pool floor 10 is provided with a main drain conduit 12 and with an inset, perforated main drain plate 14 which normally is provided with a center opening 16. The leaf trap comprises an inverted basket 18 having a perforated side wall surface 20 and a perforated top wall surface 22. The basket is provided with a center pin 24 which extends into the center opening 16 of the main drain plate 14, thereby anchoring the basket to the main drain plate against lateral drift and centrally locating the basket with reference to the plate. The lower peripheral edge of the basket engages the plate 14 directly and this serves to effectively seal the basket against the passage of leaves and other large debris into the basket below its lower edge.

The leaf trap further comprises a dome-like housing 26 having a plurality of lateral openings 28 and a top opening 30 bifurcated by a bridge element 32 which serves to prevent some automatic pool cleaners from getting caught in the top opening. The vacuum cleaner, or leaf removal, device 34, comprises a frusto-conical conduit member 36, a cylindrical side wall 38, and a frusto-conical plate 40 joining conduit 36 and side wall 38. The vacuum cleaner device is provided with a pivotable operating handle 42 and with a water inlet line 44 which delivers water from hose 46 to an annular discharge ring 48 secured within the device. Removably attached to the conduit part 36 of the cleaner is a filter bag 50. The cleaner is adapted to fit against and nest with the housing 26. The jets of water issuing from the discharge openings formed in ring 48 cause water to flow through the housing and upwardly out of the opening 30 into the bag 50. Entrained in this flow of water are the leaves 52 which had become trapped within the housing 26 due to the flow of water into the housing through the openings 28, through the basket 18 and through the main drain plate 14 under the action of the swimming pool water circulation pump. The vacuum cleaner, or leaf removal, device 34 is of course only associated with the housing when it is desired to remove the leaves which have accumulated within the housing.

What is claimed is:

1. A swimming pool leaf trap comprising a perforate basket-shaped member placed in inverted position upon and in sealing and enclosing relation to the main drain opening plate of a pool, and a dome-shaped housing in peripheral engagement with and supported by the pool floor in enclosing, spaced relation to said member and defining therewith a leaf entrapment and leaf storage space, an inlet opening formed in the side of the housing for the passage of leaves into the storage space under the influence of selective water circulation flow along a first path defined by said inlet opening, said member, and said drain opening plate, and an outlet opening formed in the top of the housing for the passage of leaves out of the storage space under the influence of alternatively selective water circulation flow along a second path defined by said housing inlet opening and said outlet opening.

2. The leaf trap of claim 1 in combination with a vacuum cleaner device engaged with said housing in communication with said outlet opening and operable to induce water flow along said second path and consequent transfer of leaves from said storage space to said vacuum cleaner device.

3. The leaf trap of claim 1 there being a plurality of inlet openings formed in the side of said housing at a level below the level of the top of said member, said outlet opening being formed in the top of said housing substantially centrally thereof.

4. The leaf trap of claim 3 in combination with a vacuum cleaner device engaged with said housing in communication with said outlet opening and operable to induce water flow along said second path and consequent transfer of leaves from said storage space to said vacuum cleaner device.

* * * * *